US005832675A

United States Patent [19]

Zuares

[11] Patent Number: 5,832,675

[45] Date of Patent: Nov. 10, 1998

[54] PREFABRICATED POST BASE FLASHING

[75] Inventor: David Zuares, 2524 W. Jefferson St., Boise, Id. 83702

[73] Assignee: David Zuares, Boise, Id.

[21] Appl. No.: 833,803

[22] Filed: Apr. 9, 1997

[51] Int. Cl.[6] ..... E04C 2/08; E04C 2/30

[52] U.S. Cl. ..... 52/60; 52/58; 52/170; 52/219; 52/97; 52/296; 52/736.4

[58] Field of Search ..... 52/58–60, 170, 52/169.13, 169.14, 219, 296, 29 A, 736.1, 736.3, 736.4, 97, 101

[56] References Cited

U.S. PATENT DOCUMENTS

| | | | |
|---|---|---|---|
| 816,719 | 4/1906 | Fell | 52/297 |
| 1,489,204 | 4/1924 | Glen | 52/297 X |
| 1,596,657 | 8/1926 | Heber | 52/170 X |
| 1,694,109 | 12/1928 | Tackar | 52/736.4 X |
| 2,240,016 | 4/1941 | Pinney | 52/296 |
| 3,871,145 | 3/1975 | Hatmaker | 52/60 X |
| 4,700,512 | 10/1987 | Laska . | |
| 5,077,943 | 1/1992 | McGrady | 52/58 |

*Primary Examiner*—Robert Canfield

[57] ABSTRACT

A prefabricated flashing for post bases intended for installation in new or existing construction comprising two different pieces. One piece having a nailing flange (22) which fits snugly around a post whose dimension is 3½"×3½" has a total of eight nail holes (20) and has four tapered sides (28) that terminates in a bottom flange (29). The second piece is shaped and sized similarly to the first except that it is split verticaly straight across the nailing flange and on one side has an extension of material (30) which creates a seam.

9 Claims, 3 Drawing Sheets

PREFABRICATED POST BASE FLASHING

BACKGROUND

1. Field of Invention

This invention relates to galvanized sheetmetal flashing, specifically to such flashings which protect standard dimensional lumber about 3½"×3½" post bases from damage caused by water.

2. Description of Prior Art

Building material dealers frequently supply builders and homeowners with rolls of galvanized sheetmetal in a variety of sizes for water-proofing exposed portions of buildings. Flashings of prefabricated shapes and sizes are also available for weather proofing standardized parts of a building.

Prefabricated flashings are an excellent product for working with a standardized purpose. Working with rolls of flashing is a good alternative when a builder or homeowner finds it necessary to flash an unusual or an infrequently encountered situation in the construction of a building.

Unfortunately when a builder or homeowner finds it necessary to create a custom flashing it is difficult to produce an exact product from a simple roll of flashing. which is available from the local supplier. Frequently the necessary tools are not available on the job site to fabricate sheetmetal into specific shapes. An alternative is to hire a sheetmetal expert to fabricate a specific flashing. This alternative is both costly and time consuming. Thus we see the importance of having prefabricated flashing available to facilitate the specific needs of builders and homeowners.

U.S. Pat. No. 4,700,512 to Laska (1986) shows an example of working with pre-fabricated flashings in a relatively standardized situation. Though Laskas flashing is for a foundation it is not functional for post bases.

OBJECTS AND ADVANTAGES

Several objects and advantages to this invention are:

(a) provides shelter for the post base from the damaging effects of water;

(b) is manufactured from galvanized sheetmetal which is durable in wet environments;

(c) is easy to install during construction;

(d) it is of simple design whereby a homeowner can install the model designed for existing construction;

(e) design facilitates use with a standardized piece of lumber which is about 3½"×3½";

(f) design facilitates use with a standardized concrete pier with an eight inch bracket protruding from it verticaly;

(g) it is paintable and it hides ugly brackets, bolts, etc.;

(h) allows "fudge" space for a post that is not perfectly centered on pier;

(i) can be mounted to a post without a pier and still provide protection against water damage; and (j) it is easy to remove and reinstall to inspect post base.

DRAWING FIGURES

In the drawings, closely related figures have the same number but different alphabetical suffixes.

REFERENCE NUMERALS IN DRAWINGS

Figure 2B:
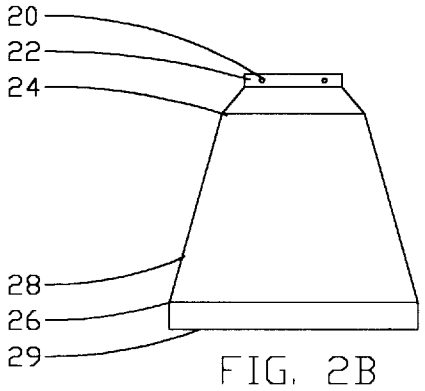
FIGS. 2A to 2C shows various aspects of the post base flashing designed for installation during construction.

10 post anchor bracket
12 3½"×3½" post
14 concrete pier
20 nail hole
22 nailing flange (full-piece version)
24 top bend
26 bottom bend
28 tapered side
29 bottom flange
30 extended material
32 inside seam
34 nailing flange (half-piece version)
36 caulk bead

SUMMARY

In accordance with the present invention a post base flashing comprises a nailing flange with nail holes and tapered sides.

DESCRIPTION—FIGS 1 TO 6C

Figure 2C:
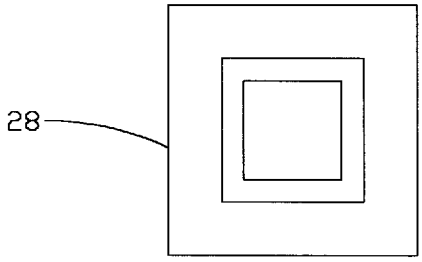
Figure 2A:
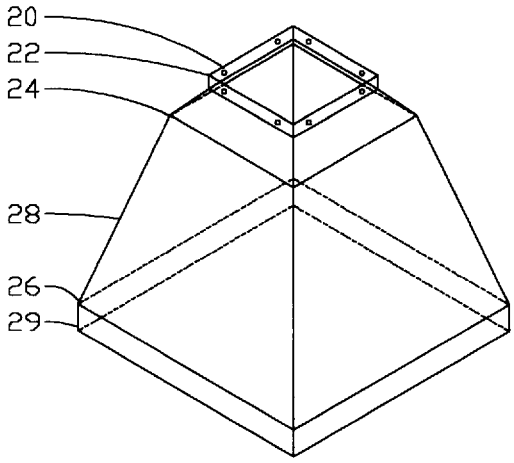
Figure 1:
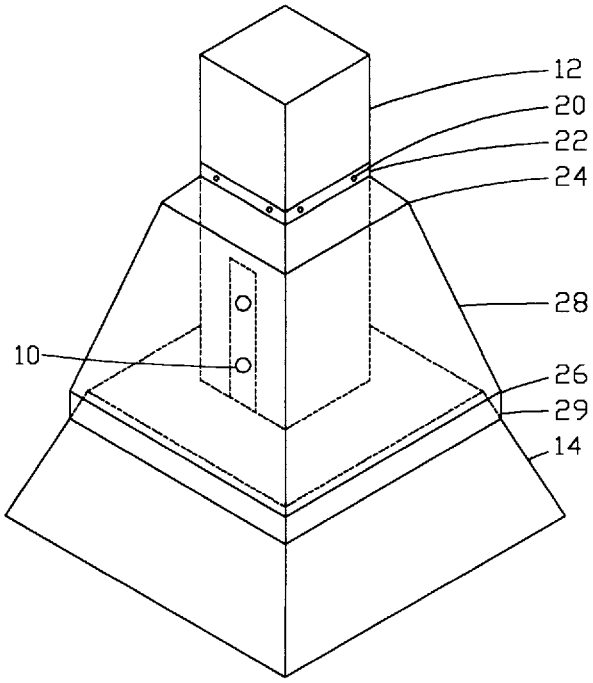
FIG. 1 shows a typical post and pier assembly incorporating the post base flashing.
Figure 3:
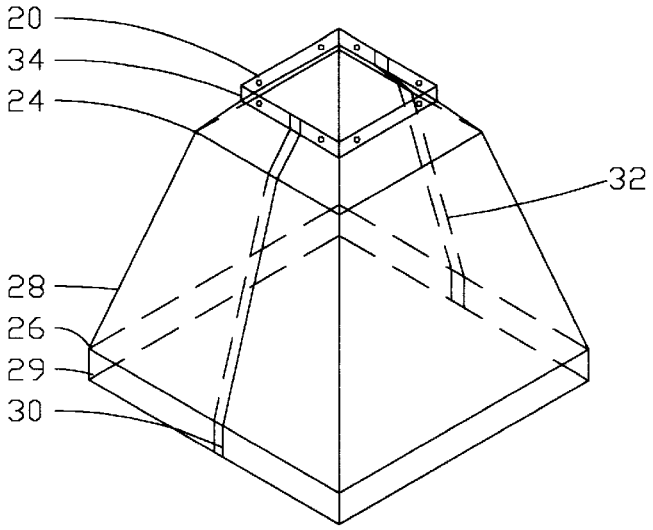
FIG. 3 shows a perspective of the post base flashing which is designed for installation to existing construction in its assembled state.
Figure 4A:
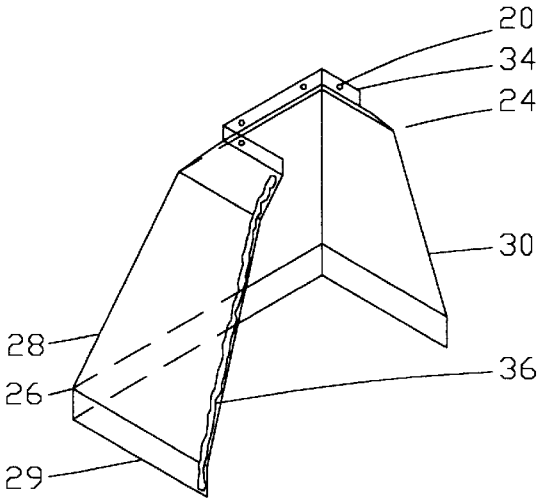
FIGS. 4A to 4B shows a perspective of the post base flashing which is designed for existing construction with inside seam visible with a bead of caulk applied to it, also with the "extended material" visible.
Figure 4B:
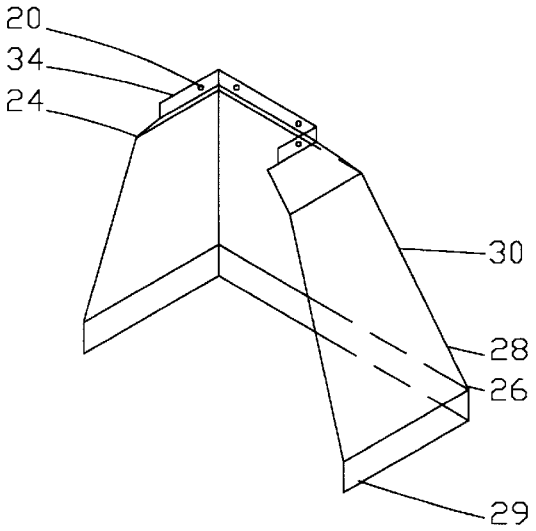
Figure 5A:
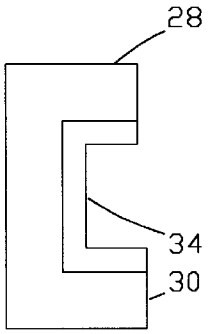
FIGS. 5A to 5C shows a top view of flashing for existing construction in its separate and assembled states.
Figure 5B:
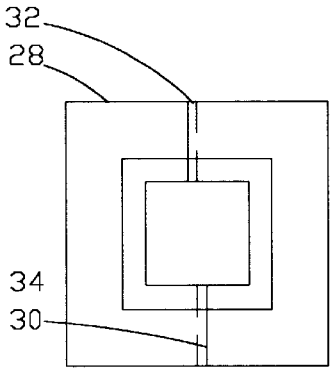
Figure 5C:
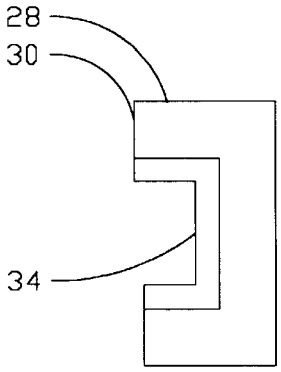
Figure 6A:
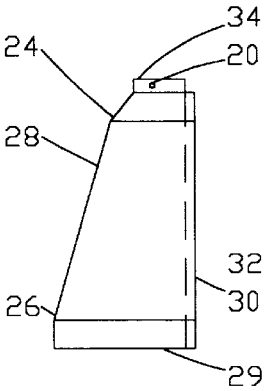
FIGS. 6A to 6C shows a side view of flashing for existing construction in its separate and assembled states.
Figure 6B:
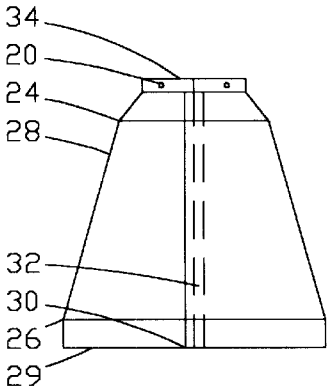
Figure 6C:
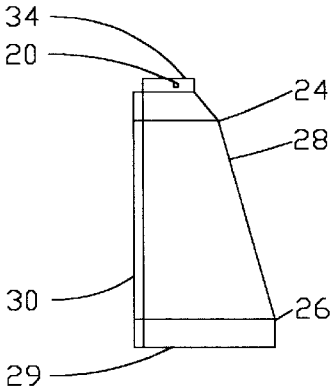

A typical application of the post base flashing of the present invention is illustrated in FIG. 1. The flashing is made from a durable gauge galvanized sheetmetal which will resist rust, average residential abuse, and provide a paintable surface. The post base flashing comprises two pieces: (a) a "full-sized" piece (FIGS. 1–2C) which is intended for installation during construction; and (b) a "half-sized" piece (FIGS. 3 to 6C) which is reversible and is intended for installation on existing construction.

The "full-piece"0 version has a top rim comprising a nailing flange 22 that is specifically designed to fit snug over a standardized piece of lumber which is 3½"×3½". The top also comprises two nail holes 20 (FIG. 2C) per side for a total of eight. The sides are sloped adequately to rapidly shed water and maintain a proportional taper from the nailing flange to the bottom. There is one bend 24 immediately below the nailing flange which initially expands flashing to facilitate the covering of nuts and bolts used in anchoring post 12 to bracket 10. The bottom also has a bend 26 which terminates the taper and allows for a small flange 29 rimming the bottom. This will facilitate a snug fit around the top of a concrete pier 14 thus creating a water tight flange.

The "half-piece" has the same shape and profile as the "full-piece" but is split vertically straight across the nailing flange. However, on one partial side there is a small amount of material extending 30 (FIGS. 4A and 4B) laterally beyond the nailing flange which when mated with inside seam 32 will create a water-proof seal when caulked. This extended material 30 starts immediately below nailing flange 34 and extends to the bottom. In both versions there is adequate height to cover common post brackets.

OPERATION—FIGS 1–4C

The installation of the "full-piece" version of the post base flashing begins with the user slipping flashing over post 12 (FIG. 1) either before or after post is mounted to pier but not after top of post has had another board installed to it thus hindering the flashing from slipping onto the post. After post has been mounted to its fondation, whether pier or other method, user cuts off excess bolt threads that may hinder flashing from seating properly. Thirdly, user slides flashing to its nailing position and creates a line around the post at the location of the top of the nailing flange. Fourthly, user raises flashing and applies a thin bead of a high quality 100% silicone caulk onto post just below created line. This creates a water-proof seal between post and flashing. Finally returns flashing to nailing position and either nails or screws flashing to post with galvanized fasteners.

The installation of the "half-piece" version of the post base flashing which is intended for existing construction begins with removing any extraneous material around post base that may hinder flashing from seating properly. Next, user "dry fits" two pieces of flashing in their final positions and creates a line around post at the location of the top of the nailing flange. Thirdly, user removes flashings and applies a thin bead of a high quality 100% silicone caulk onto post just below created line then "tacks" one flashing. Finally, user applies a modest bead of caulk 36 (FIG. 4A) to the outside of the inside seam 32 of both flashings and fastens second flashing so that extended material 30 (FIG. 3) of both pieces is over inside seam sandwiching caulk thus creating a water-proof seam.

SUMMARY, RAMIFICATIONS, AND SCOPE

Accordingly, the reader will see that the prefabricated post base flashing of this invention can be used to protect a post base from water damage with minimum cost and labor. In addition, the post base flashing is very simple to install whereby the average "do-it-yourselfer" can install the flashing with relative ease and a minimum of tools. Furthermore, the post base flashing has the additional advantages in that

- it provides a paintable surface and is shaped so that it is visually appealing;
- it is of durable construction which will resist average residential abuse and is expected to last as long or longer than the material it is designed to protect.

The primary advantage to this invention is that it will save the consumer money and headache. The most vulnerable part of post and pier construction is the post base. Not only does water drip down a post and settle at its base but water also splashes from the ground onto a post base often times bringing dirt with it delaying its drying. Furthermore, the "end grain" of lumber tends to absorb moisture and retain it whereby encouraging rot to develop. Thus we see that the post base is generally the first component to rot in post and pier construction systems. When a post base rots the post requires replacement which is a difficult task. For the less fortunate, it may be necessary to replace other construction components depending on how deeply integrated the post is with those components. Thus if the post base remains dry the need for extensive reconstruction is eliminated.

Although the description above contains many specificities, these should not be construed as limiting the scope of the invention but as merely providing illustrations of some of the presently preferred embodiments of this invention. For example, the height of the flashing can be different to facilitate various sizes of post anchor brackets; the bottom flange can be eliminated; the entire flashing can be shrunk to facilitate a very short post; the material can be changed from galvanized sheetmetal to a type of plastic, etc.

Thus the scope of the invention should be determined by their legal equivalents, rather than by the examples given.

I claim:

1. A post base flashing comprising a piece of durable sheetmetal shaped similar to a pyramid, having a square nailing flange rim on top of said flashing, said nailing flange rim provided with small nail holes, with four tapered sides below and adjacent to said nailing flange and a small flange below and adjacent each tapered side.

2. The flashing of claim 1 wherein said piece of sheetmetal is galvanized.

3. The flashing of claim 1 wherein each side of said nailing flange rim measures about three and one half inches in length.

4. The flashing of claim 1 wherein each said tapered side has a small outward slant below and adjacent to said nailing flange.

5. A post base flashing of the type comprising a piece of durable sheetmetal shaped similar to a pyramid that has been split verticaly, having a nailing flange rim on top of said flashing, with three tapered sides below and adjacent to said nailing flange, and a small flange below and adjacent each tapered side.

6. The flashing of claim 5 wherein said piece of sheetmetal is galvanized.

7. The flashing of claim 5 wherein said nailing flange rim has small nail holes.

8. The flashing of claim 5 wherein said nailing flange rim has three sides, two opposite sides being the same length and the third side being double the length of said opposite sides.

9. The nailing flange rim of claim 8 wherein said length of the two opposite sides is about one and three quarters of an inch and the length of the said third side is about three and one half inches.

* * * * *